United States Patent [19]

Yeazel et al.

[11] Patent Number: 4,872,801

[45] Date of Patent: Oct. 10, 1989

[54] SIDE REFUSE LOADER FOR VEHICLES

[75] Inventors: Kenneth L. Yeazel, Tulsa; Robert J. Forester, Broken Arrow, both of Okla.

[73] Assignee: Crane Carrier Company, Tulsa, Okla.

[21] Appl. No.: 95,409

[22] Filed: Sep. 10, 1987

[51] Int. Cl.[4] ..... B65F 3/02

[52] U.S. Cl. ..... 414/409; 414/408; 414/422; 414/421; 414/599

[58] Field of Search ..... 414/409, 420, 422, 303, 414/599, 609, 634, 635, 423, 424, 544, 421, 408

[56] References Cited

U.S. PATENT DOCUMENTS

| | | | |
|---|---|---|---|
| 2,849,134 | 8/1958 | Linde | 414/409 |
| 3,666,126 | 5/1972 | Rempel | 214/302 |
| 3,773,197 | 11/1973 | Blakeley et al. | 214/302 |
| 3,794,197 | 2/1974 | Stragier | 214/302 |
| 3,844,434 | 10/1974 | Blakeley et al. | 214/731 |
| 3,861,547 | 1/1975 | Sink, Sr. | 214/707 |
| 3,899,068 | 8/1975 | Wallace et al. | 414/599 X |
| 3,910,433 | 10/1975 | Love | 214/75 R |
| 3,910,434 | 10/1975 | Ebeling et al. | 214/302 |
| 3,942,663 | 3/1976 | Wentzel | 214/313 |
| 3,944,092 | 3/1976 | Ebeling et al. | 214/302 |
| 3,966,067 | 6/1976 | Reese | 214/302 |
| 4,005,791 | 2/1977 | Stragier et al. | 214/302 |
| 4,057,156 | 11/1977 | Thompson et al. | 414/420 X |
| 4,090,626 | 5/1978 | Ebeling et al. | 214/302 |
| 4,219,298 | 8/1980 | Stragier et al. | 414/409 |
| 4,313,707 | 2/1982 | Bingman et al. | 414/409 |
| 4,461,608 | 7/1984 | Boda | 414/408 |
| 4,484,851 | 11/1984 | Gottlieb | 414/462 |
| 4,548,542 | 10/1985 | Reese | 414/549 |
| 4,566,840 | 1/1986 | Smith | 414/408 |
| 4,597,710 | 7/1986 | Kovats | 414/409 |
| 4,669,940 | 6/1987 | Englehardt et al. | 414/409 X |

FOREIGN PATENT DOCUMENTS

| | | | |
|---|---|---|---|
| 182009 | 12/1962 | Sweden | 414/409 |

*Primary Examiner*—Frank E. Werner
*Attorney, Agent, or Firm*—Head & Johnson

[57] ABSTRACT

A trash collecting apparatus is described for mounting on a trash collection vehicle for one man side loading operation. A pair of spaced apart parallel guide rails each having a long vertical straight section and a short curved section at the top are pivotally attached to the vehicle at the top. A power cylinder is provided at the lower end of the guide rails for pushing and retracting the lower end of the guide rails form the vehicle. A pair of grabber arms are provided for grabbing the periphery of the trash can to be emptied. The grabber arms are connected to lifting arms. The lifting arms comprise an upper lifting arm segment and a lower lifting arm segment. A power cylinder drives the lifting arms so that the lower end of the lower lifting arm follows the guide rails to the curved section. The grabber arms and the grabbed container are moved by the lower end of the lower lifting arms and as the lower end of the lifting arms follows the curved portion of the guide, the containers are turned upside down over the opening in the top of the refuse collecting truck. Reverse movement of the lifting arms lowers the trash container.

4 Claims, 10 Drawing Sheets

SIDE REFUSE LOADER FOR VEHICLES

BACKGROUND OF THE INVENTION

1. Field of the Invention:

This invention relates to an apparatus for lifting a trash container or can to a dump position over a trash receiving vehicle. More particularly, the invention relates to an apparatus which is mounted preferably on the side of a trash receiving vehicle for lifting the trash container from a standard position to an inverted position over the top of the vehicle for dumping the contents of the trash container into a receiving chamber on the vehicle.

2. Background of Trash Hauling:

The pressing needs to increase the efficiency of trash collection and to reduce the costs incurred in the trash collecting process has brought about increased mechanization of trash collection. To provide a mechanism for efficiently emptying trash containers into a collection vehicle, the prior art has resorted to inumerable mechanical arrangements. These disclosed apparatus provide for trash containers or cans to be lifted from the ground and dumped into a trash collecting vehicle with the lifting mechanisms raising the trash containers over the side, front or back of the vehicle through the use of tracks, rails, articulating arms, conveyor systems and the like. These prior apparatus incorporate various degrees of complexities. It is well known in the trash collecting industry such mechanisms are subject to extremely adverse operating conditions giving rise to frequent breakdowns and resulting decrease in operating efficiency.

It is therefore an object of the present invention to provide an improved trash collection apparatus for mounting on a trash collecting vehicle to grasp and lift a trash can and to dump the contents into the top of a vehicle.

SUMMARY OF THE INVENTION

The lifting mechanism has a pair of spaced apart essentially parallel guide rails which are mounted on the side of the trash collecting vehicle. Each guide has a long straight section with a curved section at the top. The two guide rails are pivotally attached at their upper end to the trash collecting vehicle so that the lower end may be pushed away from or attracted toward the vehicle while pivoting about the pivot at the top. A pair of hydraulic cylinders are provided for positioning the lower end of these guide rails by pushing them in or out.

A pair of guide arms are provided. Each lift arm includes an upper lift arm segment and a lower lift arm segment. The upper lift arm is fixed to an upper torsion bar which extends between the upper ends of the guide rails. The lower lift arm segment and the upper lift arm segment which are about the same length, are connected by a pivot. The lower end of the lower lift arm segment is provided with two spaced apart rollers which follow the guide rail. A lower torsion bar or grabber assembly support rod, is connected between the lower ends of the two lower lift arm segments. A grabber arm assembly is supported from this lower torsion bar which assembly also includes hydraulic cylinders for opening and closing arms about a trash can sitting on the curb.

In operation the operator of the trash collecting vehicle drives a vehicle so that the trash can is adjacent the side of the truck. The lower end of the guide rails is manipulated so that the grabbers are in the proper position so that when actuated they will enclose the trash can. Then the lift cylinders are actuated to rotate the upper torsion bar which in turn rotates the upper lift arm segment which causes rollers of the lower end of the lower lift arms segment to follow the guide rails and bring with it the grabber with a trash can. Continued movement of the roller along the guide rails causes the trash can to be turned upside down over an opening in the top of the truck and the trash is dumped out. The arm lifting cylinder is then reversed so that the trash can is immediately lowered and the gripping arms are released so that the can is repositioned on the ground where it was picked up. The truck is then ready to move on to its next location.

DETAILED DESCRIPTION OF THE INVENTION

Figure 1:
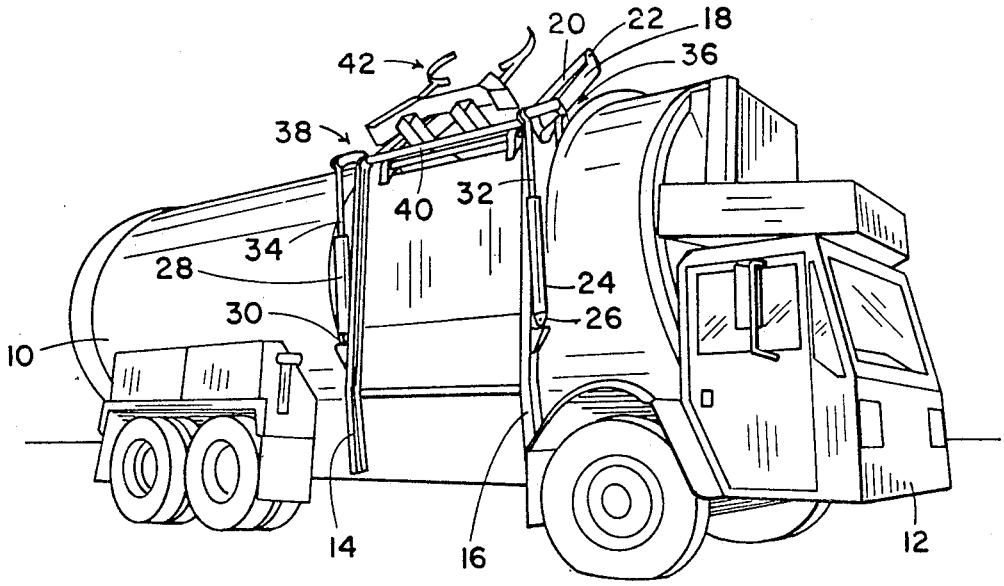
FIG. 1 illustrates a side view of a trash collecting vehicle with out side loading mechanism attached.
Figure 4:
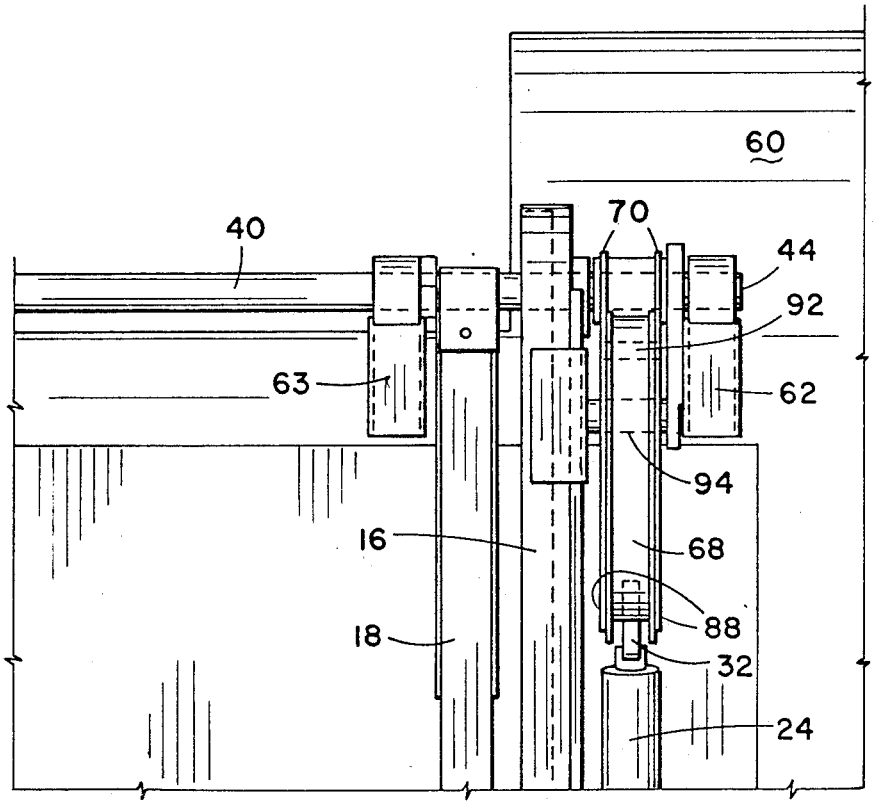
FIG. 4 is an enlarged detail view of segment "4" of FIG. 3.

Attention is first directed to FIG. 1 which shows our trash loading apparatus mounted on the side of trash collecting bin or container 10 which is supported by a vehicle or truck 12. The bin 10 is provided with an opening in the top thereof which is not shown. The trash can lifting mechanism of FIG. 1 includes guide rails 14 and 16. There is a lift arm on each quide rail. On guide rail 16 this is shown as upper lift arm segment 18 and lower lift arm segment 20 which are pivotally connected at pivot 22. A first lifting cylinder 24 is pivotally attached at 26 to guide rail 16. A second lifting cylinder 28 is likewise attached at pivot 30 to guide rails 14. The upper end of extension rod 34 of power lifting cylinders 24 and 28 are connected to a driving mechanism 36 and 38, respectively. These driving mechanisms are connected to a dumping torsion bar 40 which as will be seen causes the lifting arms to lift grabber mechanism 42 from the ground level to a position above the opening of bin 10.

Figure 2:
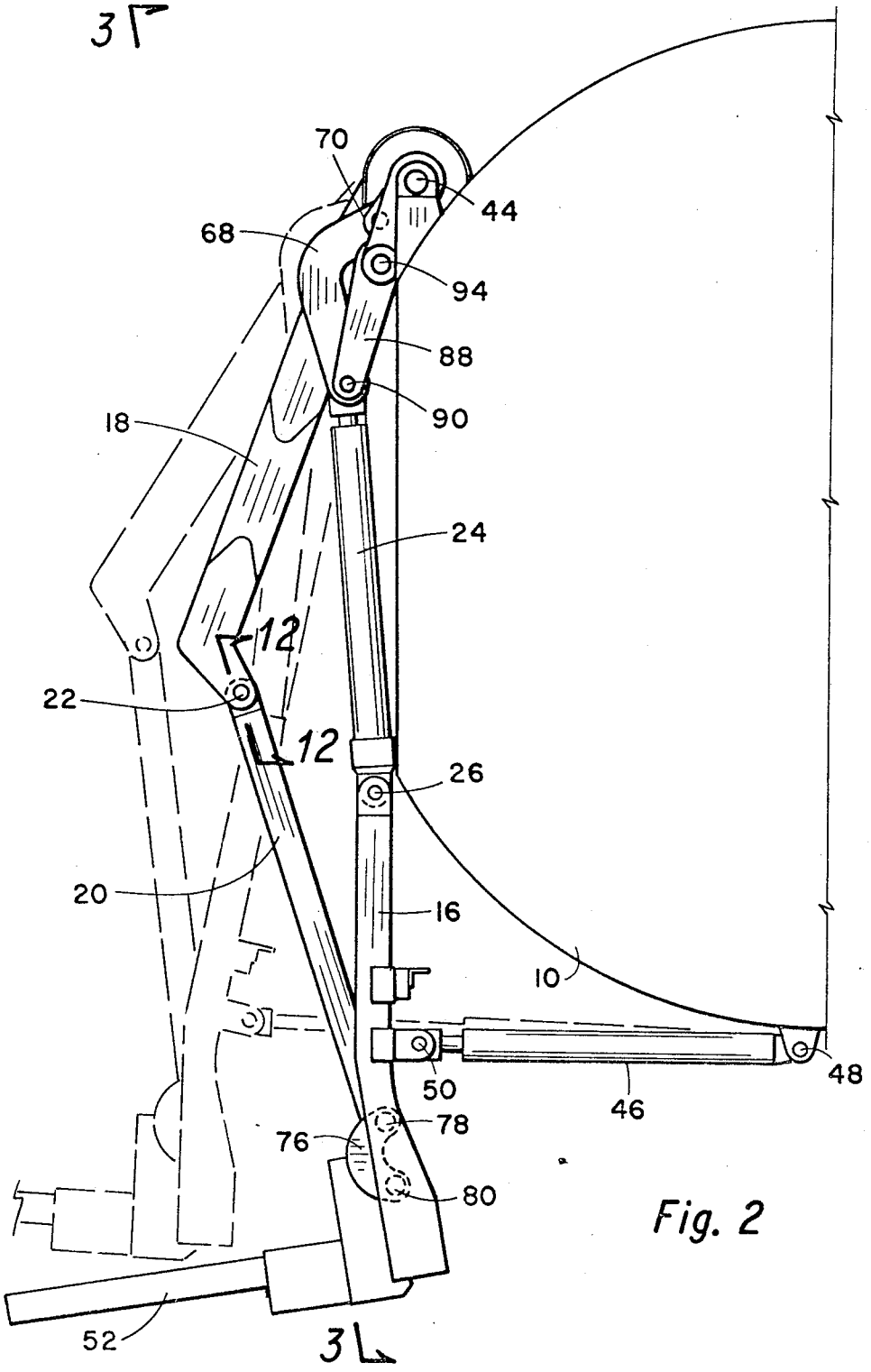
FIG. 2 illustrates the guide rail lifting arms and pivoting mechanism.
Figure 3:
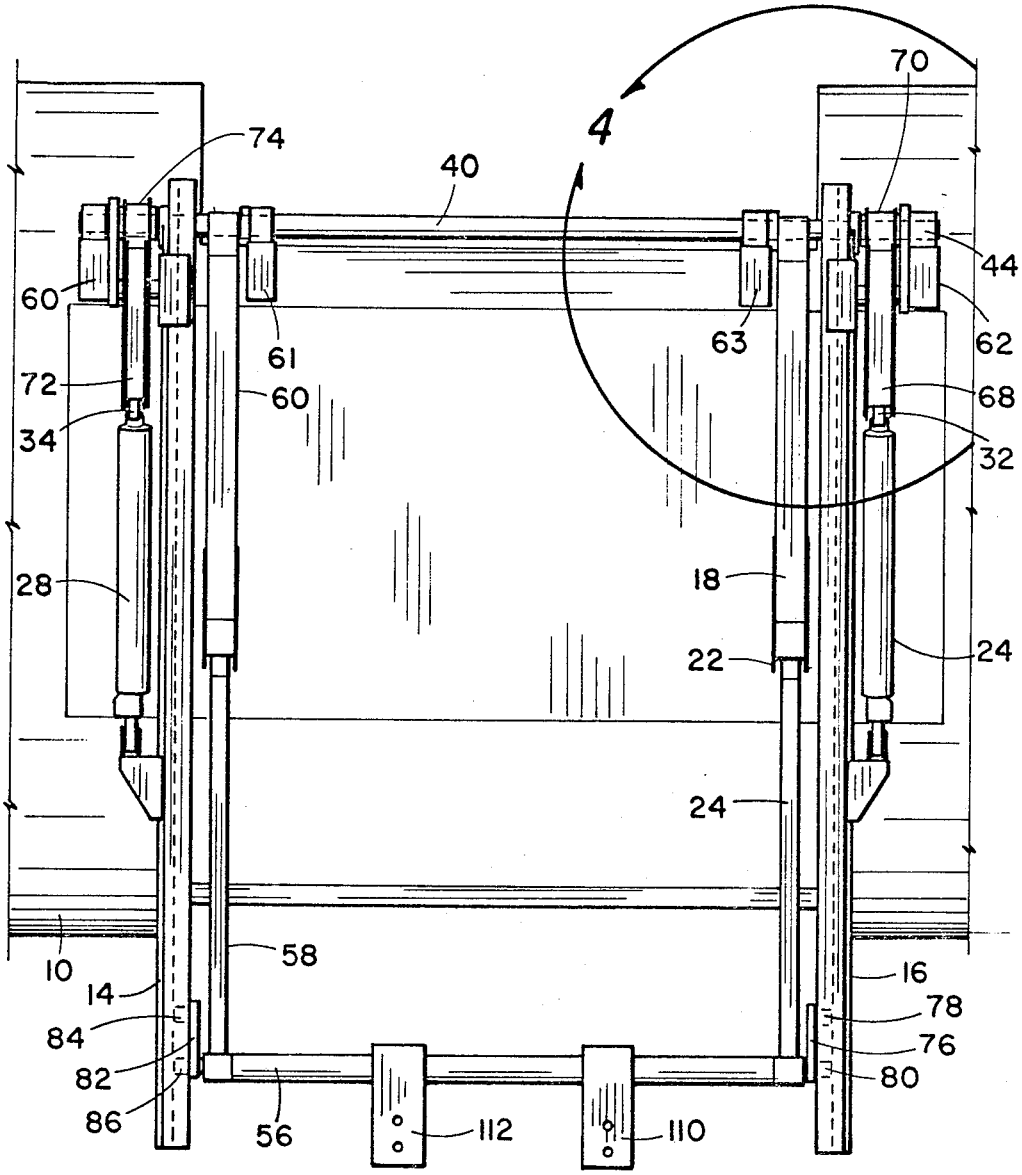
FIG. 3 is a view along the line 3—3 of FIG. 2 and illustrates a front view of the trash loading mechanism with the grabber arm assembly removed.
Figure 12:
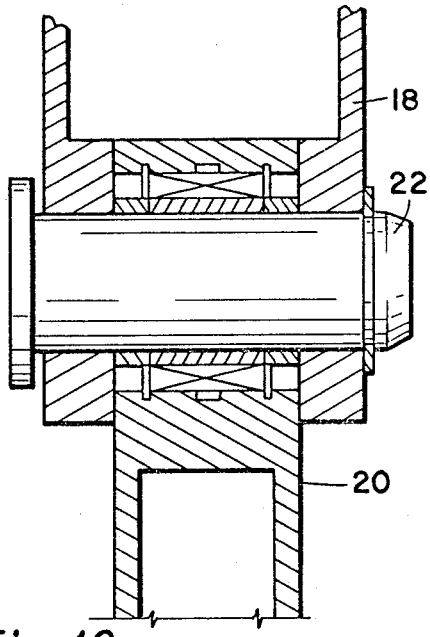
FIG. 12 is a view taken along the line 12—12 of FIG. 2.

Attention is next directed to FIG. 2 which shows a trash can grabber arm 52 approaching a trash can. This FIGURE shows guide rails 16 pivoted about point 44 at the top which is about the axis of upper torsion bar 40. Stated differently, the upper end of the guide rails are pivotally supported from torsion bar 40. As shown further in FIG. 2 the lower end of guide rail 16 can be pushed away from the bin 10. This is provided by a rail cylinder 46 connected at pivot 48 to the bin 10. The extension rod of rail cylinder 46 is connected at pivot 50 near the lower portion of lower lift arm segment 16. The dashed line of the lower end of the lift arm segment illustrates the extension of the rod from rail cylinder 46 and shows how it is shoved away. As will be seen this has a very useful purpose. As can be seen in FIGS. 2 and 3, the grabber arms 52 and 116 (FIG. 14) are supported from grabber arm assembly supports 54 which are supported from lower torsion bar 56 which is supported at the lower end of lower lift arm segment 24 on the right and on the left lower lift arm segment 58 which is supported from upper lift arm segment 60. The left hand lift arm assembly is the same as the right hand lift arm assembly. It is thus seen that by extending the piston rod of rail cylinder 46 that the grabber arm assembly can be extended to the point or position where the trash can is located. The pivotal connection between upper arm segment 18 and lower lift arm segment 20 is clearly shown in FIG. 12 which shows the pivot 26 as a pin connecting the upper lift arm segment 18 and the lower lift arm segment 16.

Attention is now directed to FIG. 3 which is a view taken along the line 3—3 of FIG. 2. At the top of FIG. 3 is the upper torsion bar 40 which is pivotally supported at one end by a support 60 and at the other end by a support 62. These supports 60 and 62 are welded or otherwise securely secured to the vehicle such as to the bin 10. Addition supports 61 and 63 are similar to supports 60 and 62 and are provided to increase the stability of tension bar 14. The torsion bar 40 rotates freely within these supports. The upper ends of guide rails 14 and 16 are mounted about upper torsion bar 40 in a rotational position. That is they can readily rotate on the bar 14. The upper end of upper lift arm segments 18 and 60 are welded or otherwise secured to the upper torsion bar 40. Thus as upper torsion bar 40 rotates, the lift arm segments 18 and 60 are also rotated. The length of the upper left arm 18 (between the center of the pivot points) is longer by a distance X than the length of the lower lift arm 24 between the center of the pivots where X equals the inner radius of the guide at the top of the guide rails plus one half the distance of the width of the guide channel.

The upper extension of lift cylinder 24 is connected to a mechanism such that the extension of rod 32 rotates upper torsion bar 40. This mechanism which will be explained more fully in relation to other FIGURES, especially 7 and 8 includes a dogleg 68, idler link 88 and a drive link 70. Lift cylinder 28 likewise has its extension rod 34 connected to mechanism 38 which includes dogleg 72, drive link 74 and an idler arm.

Attention is now directed back to FIG. 3 which shows at the lower part of the FIGURE a lower torsion bar 56 to which the lower lift arm segments 24 and 58 are pivotally attached. Each end of lower torsion bar 56 is provided with a pair of spaced apart rollers. One end of torsion bar 56 is provided with a curved plate 76 which is fixed to lower torsion bar 56. This curved plate has upper roller 78 and lower roller 80. Likewise, the other end of lower torsion bar 56 is provided with a curved plate 82 which is fixed thereto. Plate 82 supports upper roller 84 and lower roller 86. These rollers 78, 80, 84 and 86 follow guide rails 16 and 14 which are preferably provided with channels to receive these rollers.

Figure 8:
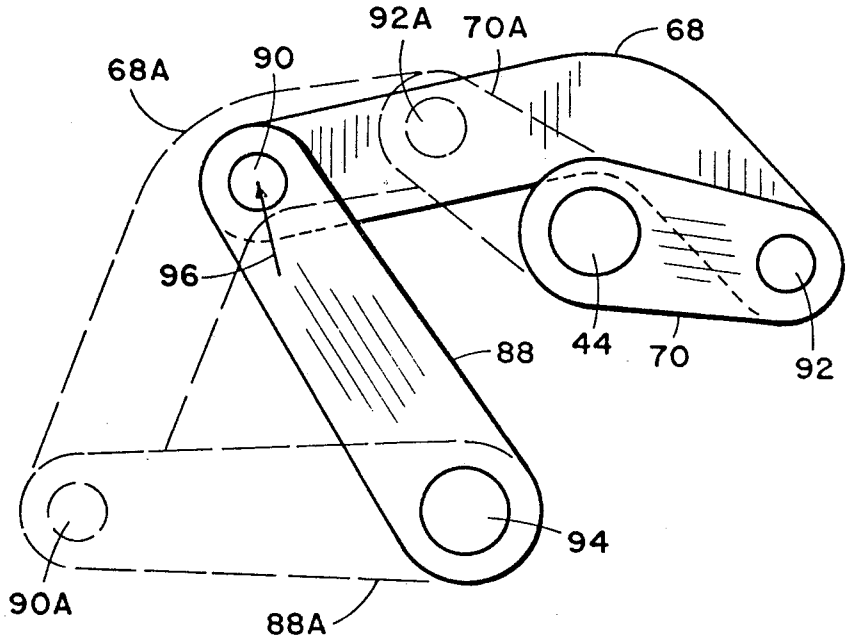
FIG. 8 is similar to FIG. 7 except it illustrates an "intermediate" position and a "full up" position of the lifting can.
Figure 7:
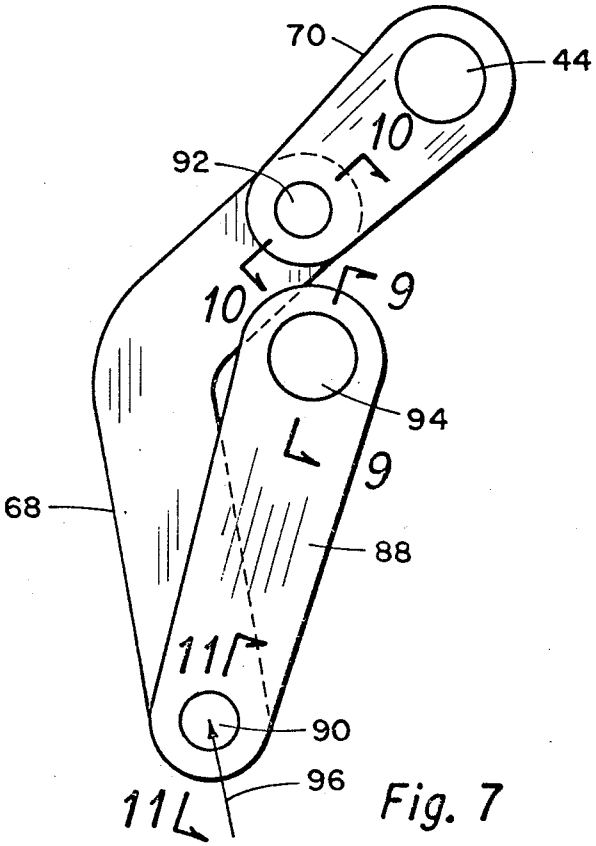
FIG. 7 illustrates a "four bar link" connecting the push rod of the hydraulic lift cylinder to the mechanism for lifting and rotating the can.
Figure 9:
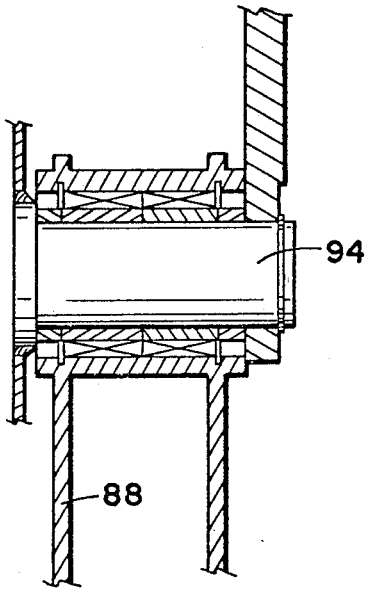
FIG. 9 is a view taken along the line 9—9 of FIG. 7.
Figure 11:
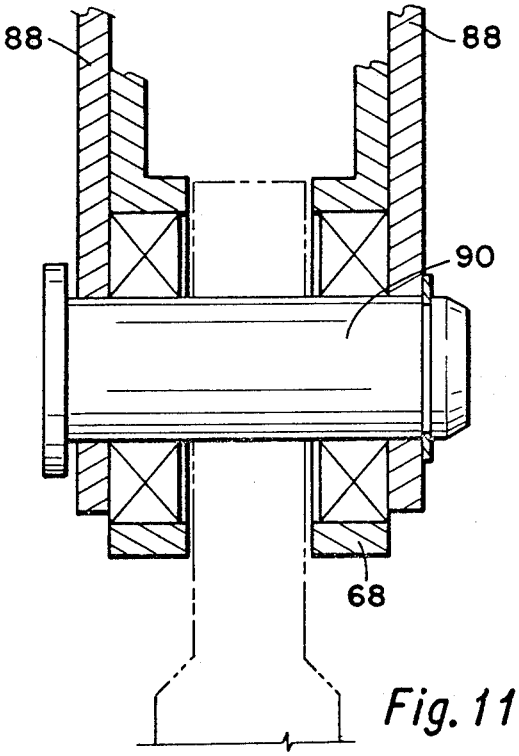
FIG. 11 is a view taken along the line 11—11 of FIG. 7.
Figure 10:
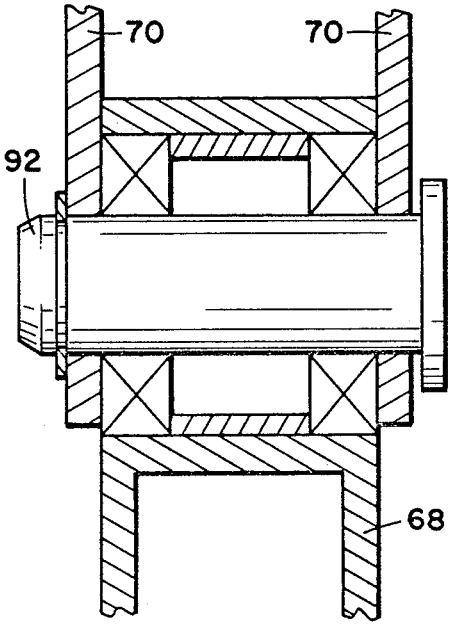
FIG. 10 is a view taken along the line 10—10 of FIG. 7.

Attention is next directed to FIGS. 7 and 8 to show the "four bar linkage" connection which connects the rods of lift cylinders 18 and 60 to the torsion bar 14. Shown thereon in FIG. 7 is dogleg 68, drive arm 70 and idler arm 88. The force, as indicated by arrow 96, from lift cylinder 24 is applied to pivot 90 which is also the pivot between dogleg 68 and idler arm 88. Driver arm 70 and dogleg 68 are connected by pivot 92. Idler arm 88 is pivotally attached about pivot point 94 which is fixed to the guide rail.

Figure 5:
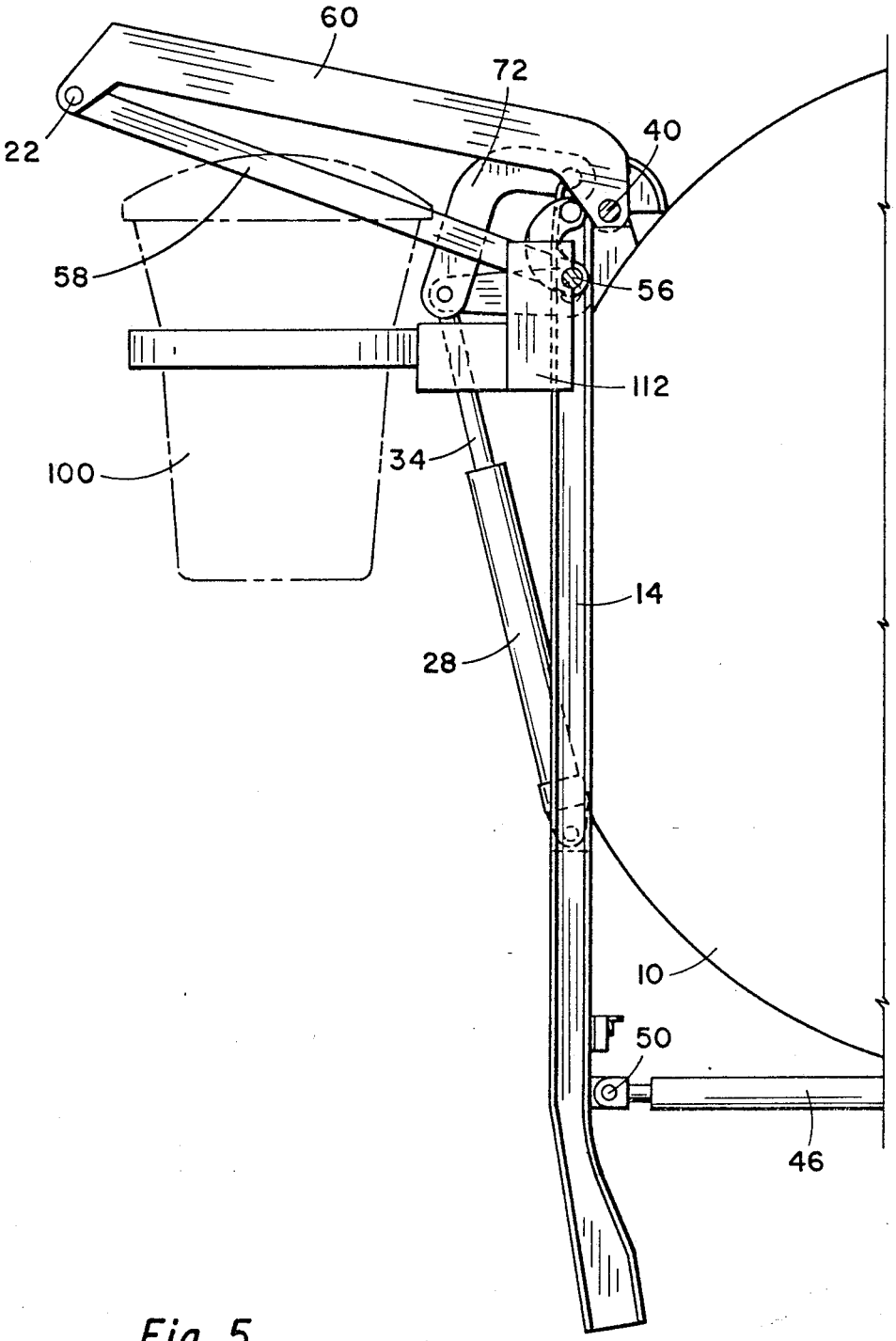
FIG. 5 shows the lift arms lifting the trash can to its highest vertical position before it tilts.
Figure 6:
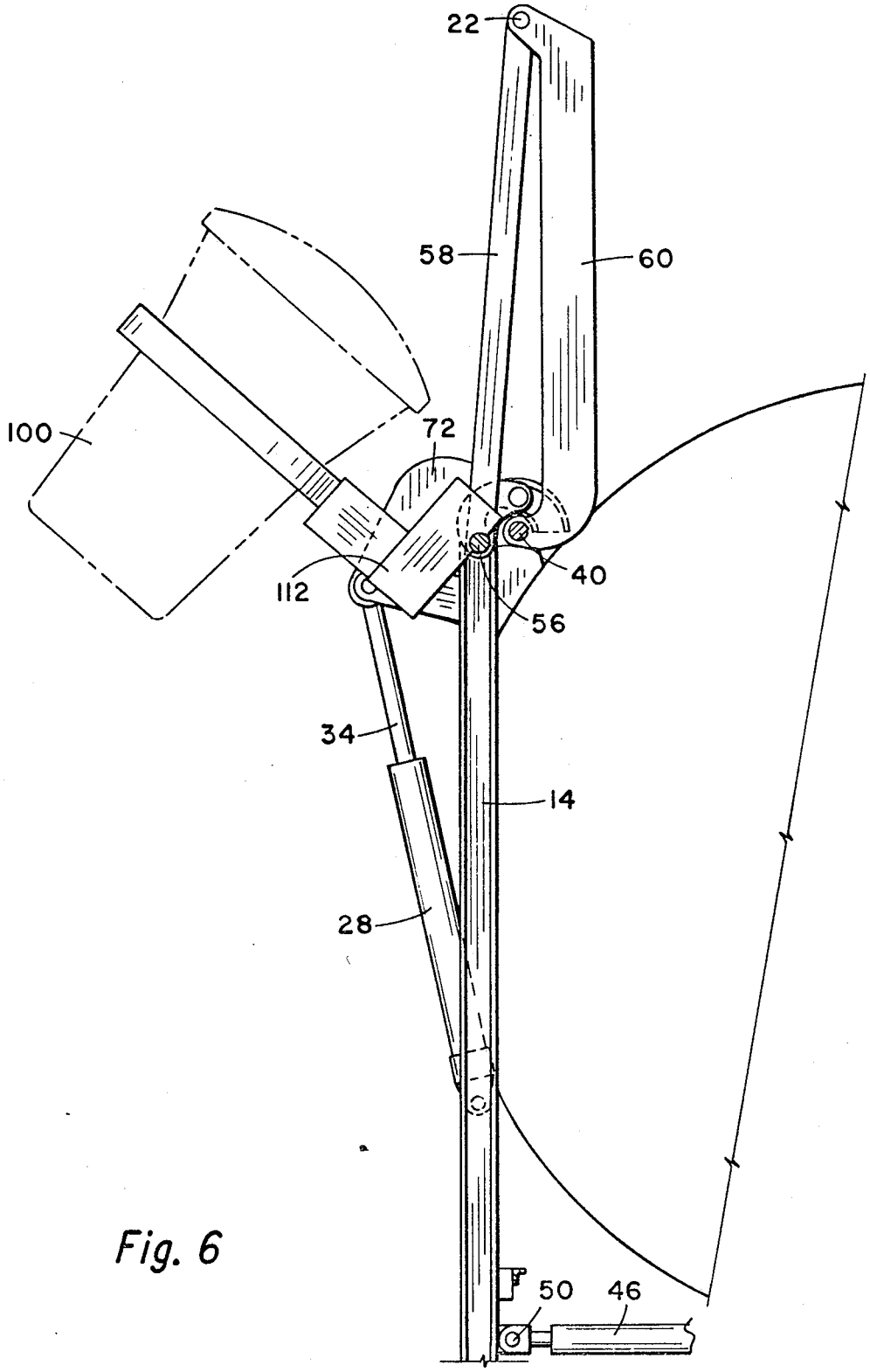
FIG. 6 is similar to FIG. 5 but is the next sequence showing the trash can tilting.
Figure 13:
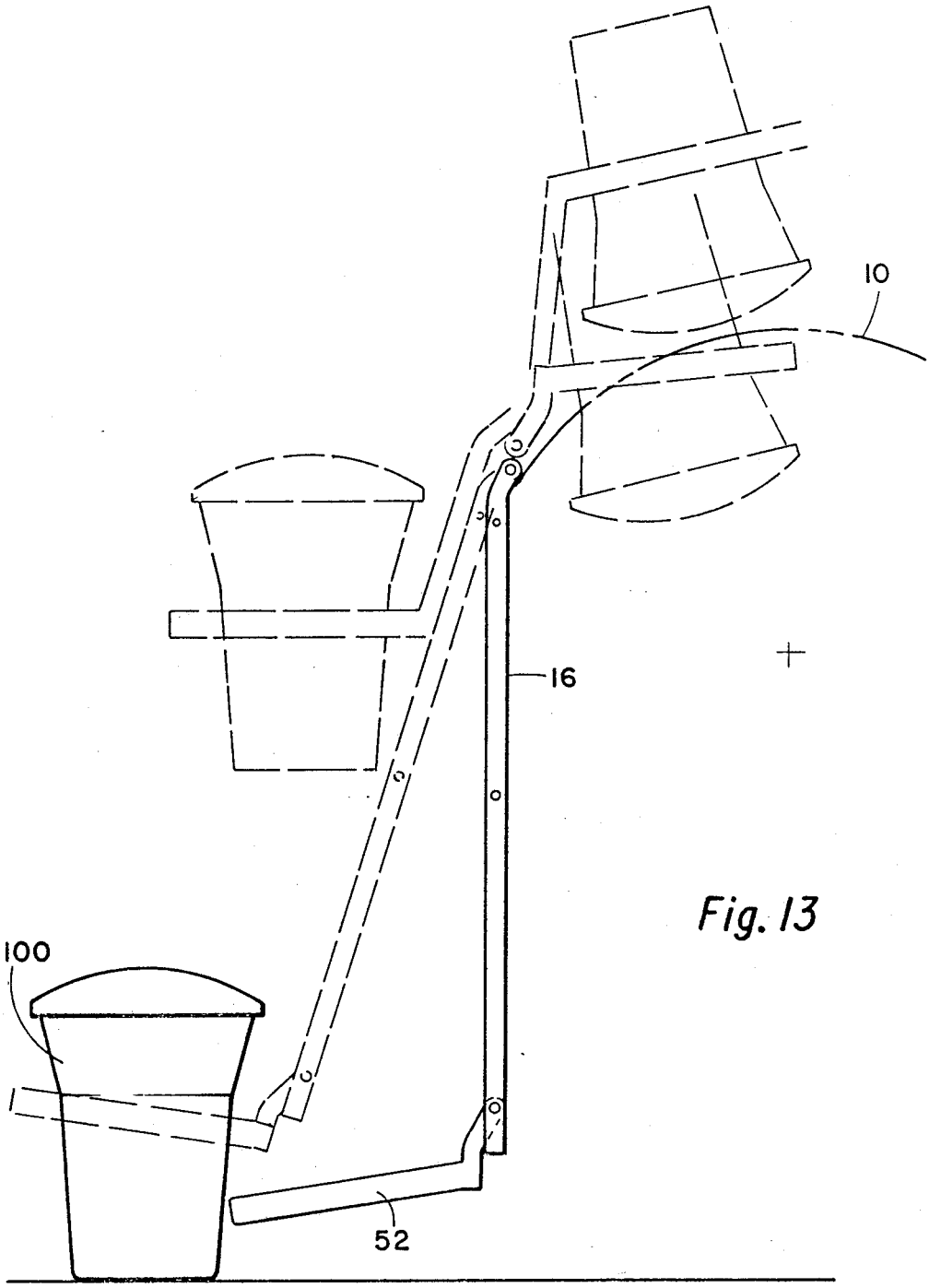
FIG. 13 is a schematic layout illustrating the trash can dumping cycle.

When upward force is applied as indicated by arrow 96 which is a force from lift cylinder 24, the idler arm 88 bent arm 68 and drive arm 70 take the position indicated by the dashed lines, 88A, 68A and 70A in FIG. 8. As the driver arm 70 rotates about axis or pivot point 44 the upper torsion bar 40 is also rotated inasmuch as driver arm 70 is keyed or otherwise fixed to the torsion bar 40. Thus, in FIG. 7 the linkage is in the down position of the lift arms and in the dashed configuration in FIG. 8 the lift arms are in an intermediate position such as illustrated in FIG. 5. There the trash can 100 is in a vertical position. Further upward movement by the piston rod 42 of the cylinder 24 will force the linkage mechanism into the position shown by the solid lines in FIG. 8 and has reached the position shown in FIG. 13 in which the trash can 100 has been turned completely upside down over the bin 10. By reversing the force on the pivot 90 that is applying fluid to drive lift cylinder 24 in the opposite direction, the linkage of FIG. 7 and 8 would just reverse from the flow up positions shown by the solid lines in FIG. 8 to the position shown in FIG. 7. This would take the lifting arms from the fully extended upright position as shown in FIG. 1 to the position in FIG. 2.

Applying fluid to cylinder 24, applies force to pivot 90 to idler arm 88 and dogleg 68. Idler arm 88 then pivots or rotates about pivot 94. This forces point 90 or the center of the pivot, to follow an arc of a fixed radius about the center of pivot 94. The dogleg forces the center of pivot 92 to move an equal distance to that traveled by point 90 inasmuch as pivot 92 and pivot 96 are a fixed distance apart inasmuch as dogleg 68 is rigid. Since driver arm 92 and idle arm 88 are not of equal length, point 92 travels unequal distances. The angular rotation of driver arm 70 about axis 44 is equal to the angular displacement of idler arm 88 about the center of pivot 94 multiplied by the length of the idler arm 88 divided by the length of driver arm 70. By length we mean the distance for the idler arm is that distance between the center of pivot 94 and the center of pivot 90 and the length of the driver arm is the distance between the center of pivot 44 and pivot 92. Typically, it is preferred that there be a displacement of about two to one so that if dogleg 68 rotates 135° then the driver arm 70 rotates about 270°. These exact displacements are not absolutely required but they have been found to be quite satisfactory.

The relationship of roller 78 and 80 with regard to the guide track will now be discussed. The two rollers maintain the orientation of the grabber arms and the can 100 which it contains with respect to the guide rail until the upper roller starts traveling around the arc at the top of the guide rail. The distance between roller 78 and 80 is substantially the same as the radius of the curved channel at the top of the guide channel or guide rail which in one model which was built was six inches. At that point the upper roller causes the lower torsion bar 56 to be rotation and this in turn causes the trash can carried by the grabbing arms to be turned upside down over the hopper area.

The lift cylinders 24 and 28 drives the driving mechanism which drives the upper torsion bar, that is it rotates it. Inasmuch as the upper arm segments are fixed to the torsion bar they rotate too. This causes the lower torsion bar to follow the guide rail.

Figure 14:
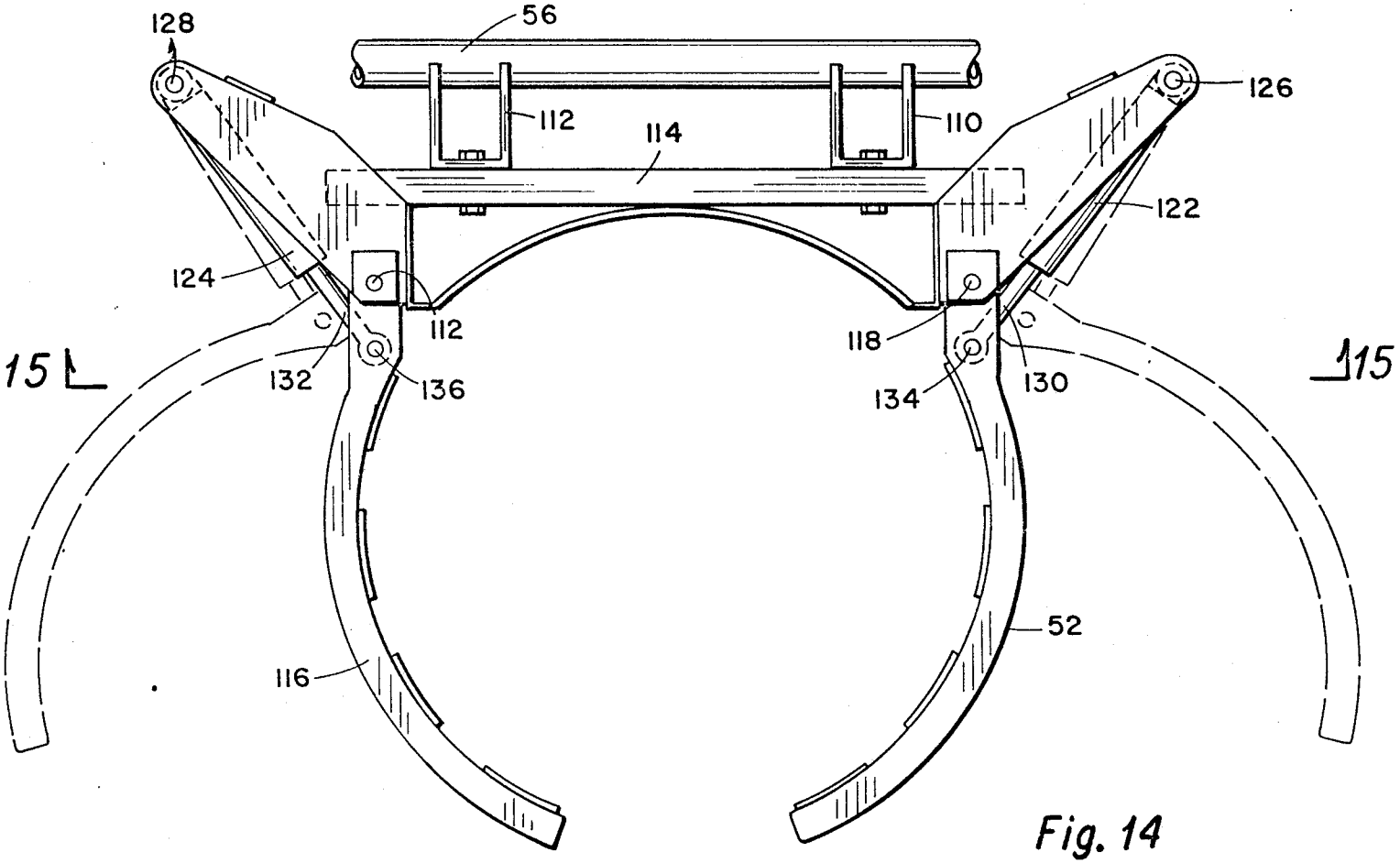
FIG. 14 illustrates a plan view of the grabber arm assembly.
Figure 15:
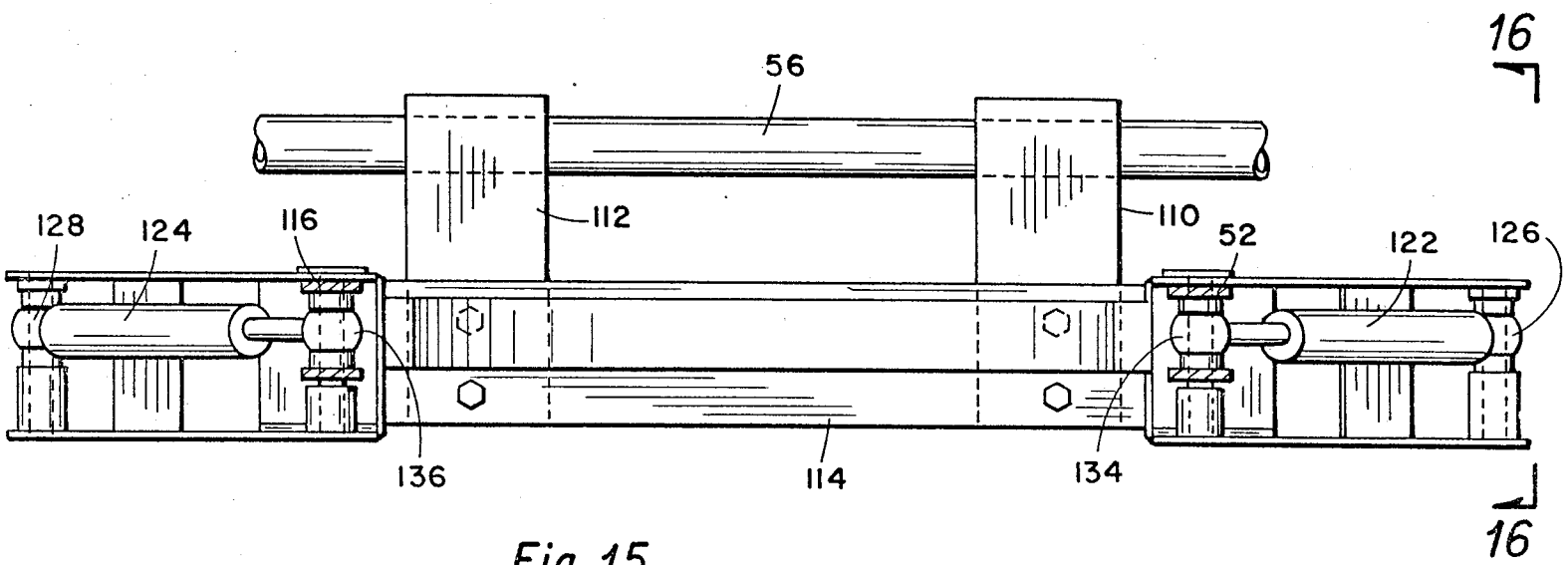
FIG. 15 is a view taken along the line 15—15 of FIG. 14.
Figure 16:
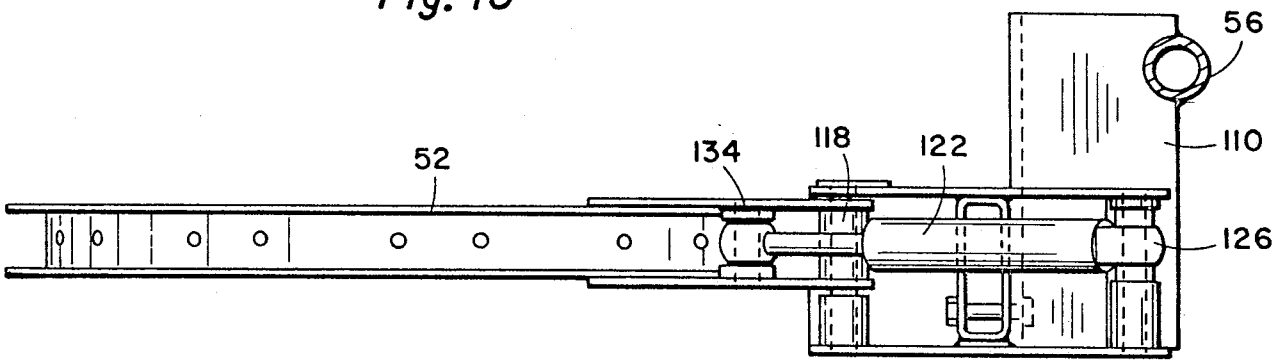
FIG. 16 is a view taken along the line 16—16 of FIG. 15.

Attention is now directed to FIGS. 14, 15 and 16 to give a brief description of a suitable grabber arm assembly for "grabbing" the trash can 100. This includes a lower torsion bar 56 to which grabber assembly mounting brackets 110 and 112 are attached. A mounting frame and bar 114 is attached to brackets 110 and 112. A first grabber arm 52 and a second grabber arm 116 are connected by pivot points 118 and 120, respective to support member 114. Grabber power cylinders 122 and 124 are pivotally supported at 126 and 128 respectively to support members 114. Grabber power cylinders 122 and 124 have extension rods 130 and 132 respectively which are connected to grabber arms 52 and 116 at pivot points 134 and 136. When cylinders 122 and 124 are in the retracted position, grabber arm 52 and 116 are in the dashed line position. When it is desired to pick up a trash can, the trash can is positioned between the extended arms. This is accomplished by having the arms extended as shown in FIG. 14 and also by having the manipulating reel cylinder 46 to move the grabber arms in or out from the truck. When the proper position is reached the cylinders 122 and 124 are extended. This forces the grabber arms into the position shown by the solid lines in FIG. 114.

This is a very efficient device for dumping trash out of trash cans into a garbage truck. One drives the trash truck until the loading apparatus on the link is laterally adjacent the trash can. Then the operator moves the rails in by actuating rail cylinder 46 until it is in the proper position and then actuates grabber cylinders 122 and 124 so that the trash can is "grabbed". Lift cylinders 24 and 28 are then energized. The rest is automatic. The can is lifted quickly through the sequence indicated in FIG. 13 and emptied. By reversal of the process the can is placed on the curb. This is accomplished by energizing cylinders 24 and 28 to retract them. When the can reaches the ground, the grabber arms 52 and 116 are extended by contracting cylinders 122 and 124. Reel cylinders 46 are then retracted. When then drive the truck to the next can. This is a very efficient operation. In fact, with cans spaced forty feet apart, the system has been operated so that it takes only about eight seconds to empty one can and drive to the next can and be ready to run the operation on it. It is anticipated that this system can service over one thousand cans in a day.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What we claim is:

1. An apparatus for use in lifting a trash can off the ground to above the bin of a refuse collection vehicle so that the trash can is emptied through a hole in the top of said bin which comprises:

two guide rails each with a guide channel having a long straight section and a curved section at the top end;

an upper torsion bar rotatably supported from said bin at a fixed location with respect thereto near the top of said guide rails;

means rotatably attaching the top ends of said guide rails to said upper torsion bar in a non-sliding relationship;

push means pivotally connected to a lower end of the guide rails and said bin to rotate the guide rails about the upper torsion bar;

grabber means for grabbing said trash can;

a pair of lift arms, each said arm having an upper arm segment and a lower arm segment;

means rigidly attaching the upper end of said upper arm segments to said upper torsion bar;

means pivotally connecting the lower end of said lower arm segments to said grabber means including roller means to guide the grabber means along said guide channel;

means to rotate said upper torsion bar.

2. An apparatus as defined in claim 1 in which said upper arm segment and said lower arm segment are connected by a pivot.

3. An apparatus as defined in claim 2 in which said grabbing means includes:

a lower torsion bar;

a plate attached to each end of said lower torsion bar;

two spaced apart rollers on each said plate positioned in the channels of said guide rails, the distance between said rollers being about equal to the radius of said curved section of said guide rail.

4. An apparatus as defined in claim 1 in which said means to rotate said torsion bar includes:

a four bar linkage having an idler arm having a first and second end with said first end pivotally attached to one of said guide rails, a dogleg arm having a first and a second end with said first end pivotally attached to said second end of said idler arm, a drive arm having a first and second end with said first and pivotally attached to said second end of said dogleg and the second end of said drive arm non-rotatably attached to said upper torsion bar ;

a cylinder pivotally connected at one end to one of said guide rails and at the other end to the pivot between said dogleg arm and said idler arm of said four bar linkage.

* * * * *